United States Patent [19]

Gilbert

[11] 4,223,827

[45] Sep. 23, 1980

[54] HAZARDOUS MATERIALS CONTAINER

[75] Inventor: Earl F. Gilbert, Farmington Hill, Mich.

[73] Assignee: Westvaco Corporation, New York, N.Y.

[21] Appl. No.: 113,104

[22] Filed: Jan. 17, 1980

[51] Int. Cl.[3] ..... B65D 3/24

[52] U.S. Cl. ..... 229/15; 229/42; 206/433

[58] Field of Search ..... 229/15, 42; 206/427, 206/433, 434

[56] References Cited

U.S. PATENT DOCUMENTS

| | | | |
|---|---|---|---|
| 1,309,877 | 7/1919 | Browne | 206/433 |
| 2,580,043 | 12/1951 | Paige | 206/433 X |
| 2,653,708 | 9/1953 | Spalding | 229/15 X |
| 2,665,026 | 1/1954 | Katzman | 229/15 X |
| 2,749,012 | 6/1956 | Beach | 206/521 X |
| 3,482,756 | 12/1969 | Collie | 206/427 X |
| 3,756,496 | 9/1973 | Oostdik | 229/15 |
| 3,871,569 | 3/1975 | Wharton, Jr. | 229/15 |
| 3,985,286 | 10/1976 | Hicks | 229/15 |

FOREIGN PATENT DOCUMENTS

| | | | |
|---|---|---|---|
| 1268836 | 3/1972 | United Kingdom | 206/434 |

*Primary Examiner*—Davis T. Moorhead

[57] ABSTRACT

A hazardous materials container comprises an outer shipping container and a one piece divider formed from a cut and scored blank of corrugated paperboard or the like. The divider element is alternately scored to provide a plurality of serially connected panels which are folded to form a plurality of cells for storing the hazardous materials. As folded, the divider panels provide an inner liner for the shipping container, a means for separating the hazardous materials to prevent breakage and a means for retaining the hazardous materials in place.

8 Claims, 4 Drawing Figures

HAZARDOUS MATERIALS CONTAINER

BACKGROUND OF INVENTION

The packaging and shipment of explosives, dangerous articles and other hazardous commodities is governed by various regulations issued by the Interstate Commerce Commission and the various carriers. Included in the designated group of hazardous materials are flammable liquids and solids, corrosive materials, acids, poisons, oxidizing agents and other related goods. The regulations limit the quantity which can be handled in one package or shipment, define the types of inner containers which may be used and specify the materials and construction of the shipping containers that are acceptable. For instance, Tariff No. 32 (Hazardous Materials Regulations Book) specifies a 275 lb. outer container with a liner and separators for gallon jugs of chemicals. In order to satisfy these regulations, it is well known to provide an outer shipping container with dividers which subdivide the interior and increase the stacking strength of the container.

The dividers may be either of one piece or multiple piece construction. The one piece dividers are generally formed from cut and scored blanks of paperboard which are folded to form cells for the packaged products. Meanwhile, the multiple piece dividers generally comprise one or more divider elements which extend longitudinally of the outer container and one or more transverse divider members which intersect the longitudinal elements and extend between the side walls of the container. However, one piece dividers are preferred since they are more economical to manufacture, they are generally more easily set up for use and they add considerable strength to the container for the amount of material used. Examples of prior art dividers of this class are shown in U.S. Pat. Nos. 3,985,286; 3,871,569; 3,756,496; and 2,653,708. The features illustrated in the foregoing patents are typical of the dividers used in the past. However, unlike the present invention, the dividers used heretofore have not provided the desired protection required for shipping hazardous materials.

SUMMARY OF INVENTION

In accordance with the present invention, there is provided a hazardous materials container which comprises in combination an outer shipping container and a cut and scored one piece divider element which serves several purposes. The outer shipping container is of straight forward construction consisting of a 275 lb. Regular slotted box prepared from B and C flute corrugated paperboard. On the other hand, the divider element disclosed herein is of unique construction since it is prepared from a one piece blank of corrugated paperboard that is cut and scored to produce a plurality of serially connected panels, which when folded, provide individual cells for packaging a plurality of bottles of hazardous materials and for retaining the bottles in place and separated from one another during shipment.

The divider of the present invention is preferably designed for packaging three one gallon plastic bottles of chemicals wherein the chemicals are mixed on a 2:1 basis. The plastic bottles are of typical milk bottle construction, i.e., they include handles and they have valved tops which can be connected directly to the mixing device for the chemicals. For retaining the bottles in place during shipment, the divider element of the present invention includes cut outs and flaps for locking the handle portions of the individual bottles within the outer shipping container.

The exemplary embodiment of the present invention is prepared from a one piece blank of paperboard that is scored to be of substantially symmetrical configuration. That is, the blank is provided with a central panel that is sized so as to lie along one of the side walls of the outer shipping container. Meanwhile, there is attached at each side of the central panel six separate panels of various size for forming three separate compartments for the shipping container. It will be understood in this regard that where more than three bottles of hazardous materials are to be packaged in a single container, the number of panels and compartments would be increased accordingly. However, for the three bottle package of the present invention, the second and third panels on each side of the central panel are partially cut to provide flaps which become engaged within the handles of the packaged bottles. Meanwhile, a pair of flaps are foldably attached to the ends of the sixth panel at each side of the central panel which are also used for securing the handles of the bottles packaged in the container. The blank is provided with reverse scores on the back side thereof where necessary so that the blank may be folded back upon itself where desired. In this manner, the blank not only provides panels which become aligned with and lie adjacent to the side walls of the outer shipping container, but also provides panels which are angularly oriented with respect to the shipping container side walls to extend inwardly toward the center of the container. In this manner, the divider element adds measurably to the overall stacking strength of the outer container and also provides a more than adequate separating function for the individual bottles packaged therein.

The divider is arranged in the outer shipping container with its centarlly located panel lying adjacent to one side wall. The first pair of panels attached to the central panel are folded to extend diagonally from the adjacent corners of the outer shipping container toward the center of the container. The second pair of panels, a portion of which are cut to provide bottle retaining flaps are also oriented to extend substantially toward the center of the container while the flaps are reversely folded to engage a first bottle of hazardous material. The third pair of panels from the central panel, which also have a portion cut away to provide a locking means for additional bottles of hazardous materials are reversely folded to extend substantially perpendicular from the center of the outer container toward two opposed side walls of the outer container. The bottle retaining flaps that are attached to the third pair of panels remain near the center of the container while the fourth pair of divider panels attached to the central panel become oriented along the two opposed side walls of the outer container. The fourth pair of divider panels are sized so as to extend to the remote adjacent corners of the outer shipping container to provide extra strength for the outer container and to provide a wedge effect for keeping the individual bottles of hazardous materials in place. Meanwhile, the fifth pair of divider panels counting from the central panel are arranged to lie adjacent to the side wall of the outer container opposite the side wall where the central panel is located, and are sized so as to meet at or near the mid point thereof. At that point, the sixth pair of divider panels are arranged to be adjacent to one another and extend toward the center of the outer container for a distance sufficient to enable the flaps that are foldably attached thereto to engage the handle portions of the other two bottles packaged in the outer container. Accordingly, the divider element specifically described and claimed herein provides three separate compartments located around a centrally located open area in a substantially square outer container for packaging three individual gallon containers of hazardous materials. The flap portions attached to the second pair of panels counting from the central divider panel are adapted to engage the handle of one gallon container, while the flaps attached to one of the third pair of panels and to one of the sixth pair of panels capture another gallon container and the flaps attached to the other of the third pair of panels and to the other of the sixth pair of panels capture the third gallon container. In this manner the divider element provides adequate separation between the three individual gallon containers to prevent breakage and inadvertent mixing while retaining the individual gallon containers in place. Moreover, the arrangement of the divider element within the outer shipping container provides increased strength for the overall package to more than adequately meet the shipping requirements required therefor.

DETAILED DESCRIPTION

Figure 1:
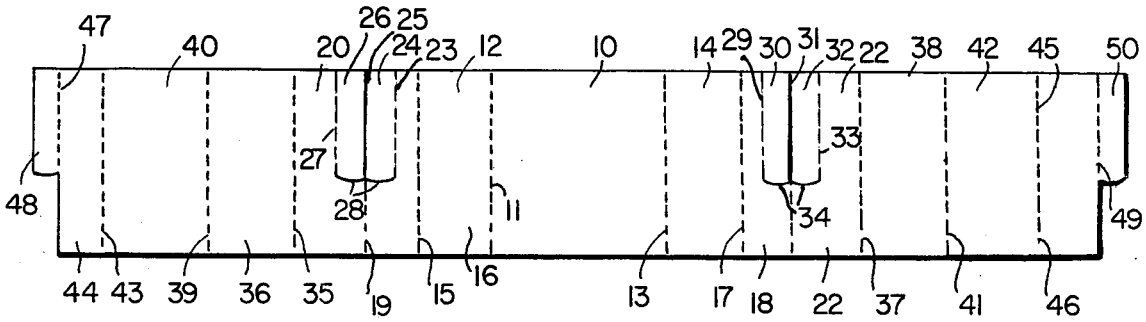
FIG. 1 is a plan view of a typical blank used for forming the divider element according to the present invention.
Figure 3:
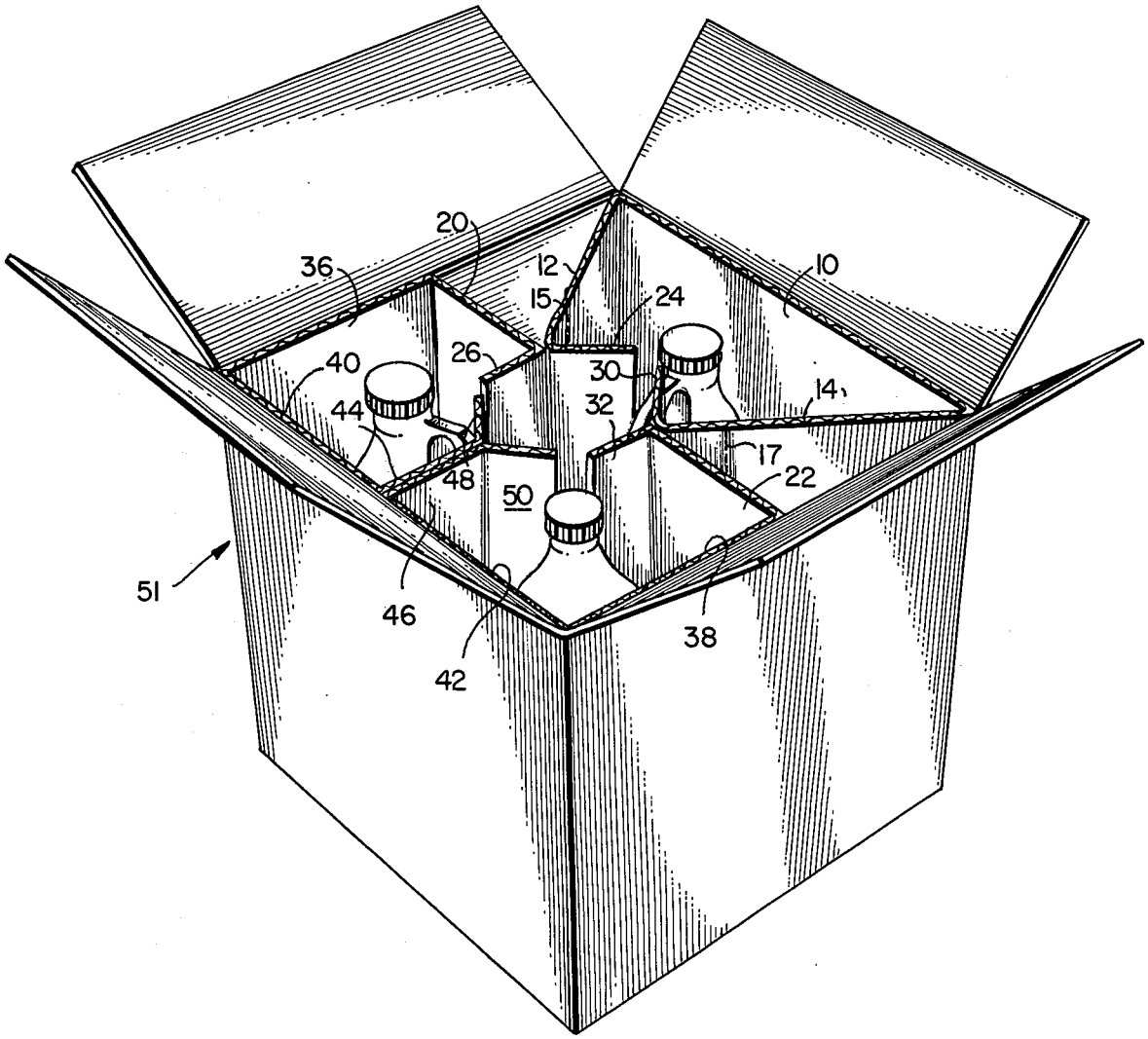
FIG. 3 is a perspective view showing the combination divider and outer shipping container of the preferred embodiment disclosed; and, FIG. 4 is a top view of the final container showing the orientation of the divider panels and the individual gallon containers of hazardous materials.
Figure 2:
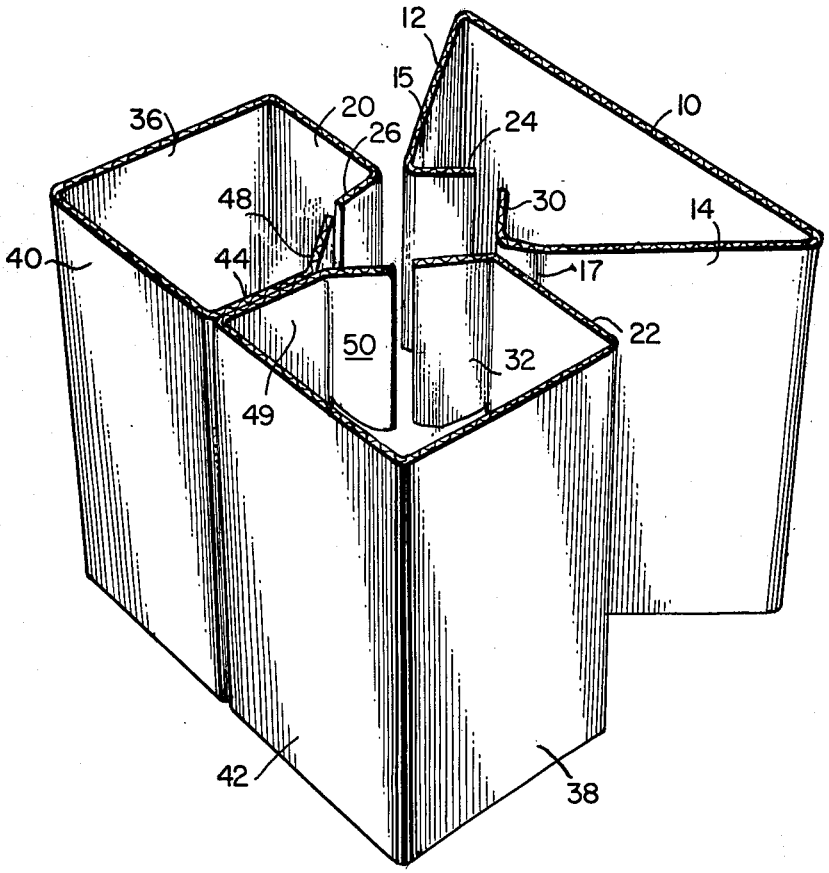
FIG. 2 is a perspective view showing the divider element of the preferred embodiment disclosed.
Figure 4:
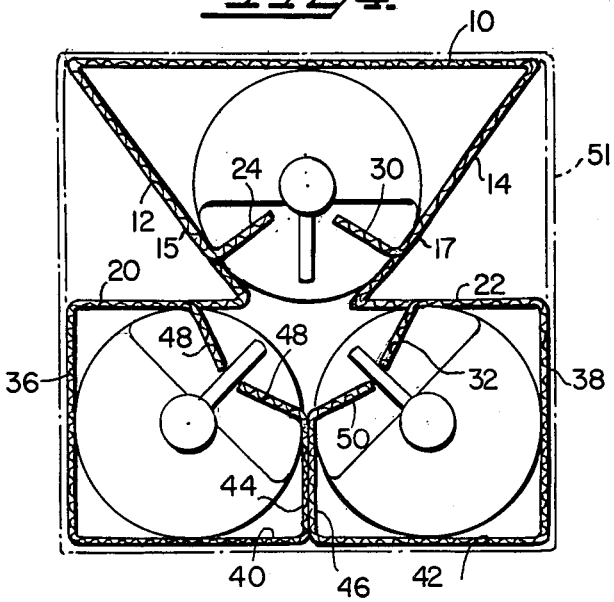

An exemplary construction of a blank for forming the preferred embodiment of the divider of the present invention is illustrated in FIG. 1. The blank is seen to comprise a rectangular sheet of flexible material, preferably corrugated paperboard, that is slit and scored as shown.

The blank includes a central panel 10 flanked by six pairs of substantially identical panels and a pair of abbreviated flaps foldably attached to the sixth pair of panels. The first pair of panels designated 12 and 14 are foldably attached to the central panel 10 along parallel fold lines 11, 13. Central panel 10 is preferably sized so as to extend completely along one side wall of a mating outer shipping container 51 in order to form the three compartmented container fully illustrated herein. However, it will be understood that, where fewer or more individual compartments are desired, the central panel 10 would be constructed and sized accordingly. A second pair of panels 16 and 18 are foldably connected to the first pair along score lines 15 and 17. Each of the second pair of panels are further cut and scored to provide, near the upper ends thereof, a pair of abbreviated flaps 24,30 formed by the score lines 23 and 29 located in the panels 16 and 18; cut lines 28,34 oriented generally perpendicular to the score lines 23,29; and, cut lines 25,31 which are coextensive with the score lines 19 and 21 which separate the third pair of panels 20,22 from the second pair 16,18. In like manner, the third pair of panels have abbreviated flaps cut from the upper portions thereof and formed by the cut lines 25,31; generally perpendicularly oriented cut lines 28,34; and, by score lines 27,33 located within the third pair of panels 20,22. The abbreviated flaps 24,26 and 30,32 are sized and shaped to serve as retainers for engaging the handle portions of individual bottles packaged in the outer container whereby the individual bottles may be held in place and separated from one another during shipment to prevent accidental breakage and/or mixing of the contents. Meanwhile, a fourth pair of panels 36,38 are foldably attached to the third pair 20,22 along score lines 35,37; a fifth pair of panels 40,42 are foldably attached to the fourth pair 36,38 along score lines 39,41; and, a sixth pair of panels 44,46 are foldably attached to the fifth pair 40,42 along score lines 43,45. The blank is completed with the addition of a pair of abbreviated flaps 48,50 which are foldably attached to the sixth pair of panels along score lines 47,49. The various panel pairs of the blank each serve to form divider elements for defining the three individual compartments of the outer container and the abbreviated flaps act as retainers for maintaining the position of the bottles or the like located in the individual compartments.

When working with the specific embodiment shown herein, the divider element is inserted in an outer shipping container as follows. Panel 10 is arranged in the outer container 51 along one side wall. The first pair of panels 12,14 are folded to extend diagonally from the two adjacent corners of the outer container toward the center of the container. The second pair of panels 16,18 are also generally oriented in the same direction while the third pair of panels 20,22 are folded reversely to extend away from the center of the container 51 toward two opposed side walls. The next pair of panels 36,38 are aligned along the opposed side walls of the container and extend to the next adjacent corners thereof. From that point, the fifth pair of panels 40,42 are folded back to lie adjacent the side wall of the outer container 51 opposite the central panel 10 and the sixth pair of panels 44,46 are folded to extend back again toward the center of the outer container.

When the divider element is folded as described above, three separate compartments are formed within a substantially square outer shipping container. The arrangement of the various panels leaves available three pairs of abbreviated locking flaps 24,30 and 26,48 and 32,50 for securing the handles of three one gallon jugs of hazardous materials placed in the individual compartments. For this purpose, as the jugs are placed in the outer shipping container, the flaps are folded around and secured within the handles located on the jugs.

Thus, while the invention has been specifically described in connection with one specific embodiment, it is to be understood that no limitations are intended since it is obvious that changes may be made within the scope of the appended claims.

I claim:

1. A hazardous materials container comprising in combination an outer shipping container and a divider member, said divider member being prepared from a one piece blank to provide a plurality of serially connected panels which are arranged to divide the outer container into at least three compartments for accomodating individual bottles of hazardous materials, said divider member further including integral abbreviated flaps formed from portions of selected divider panels which are adapted to grip the individual bottles for retaining the bottles in place.

2. The container of claim 1 wherein the divider member blank is scored to produce a central panel that is flanked on either side by a plurality of pairs of separate divider panels that are foldably connected together and to the central panel.

3. The container of claim 2 wherein the panels of the divider member are folded to provide panels adjacent to the outer container side walls and panels arranged substantially perpendicular to the outer container side walls.

4. The container of claim 3 wherein the divider member central panel is flanked by six pairs of separate panels arranged on each side thereof and a single pair of abbreviated flaps foldably attached to the sixth pair of panels.

5. The container of claim 4 wherein the second and third pairs of panels on each side of the central panel are further cut and scored to provide additional sets of abbreviated flaps located adjacent to one another.

6. The container of claim 5 wherein the divider member is arranged in the outer shipping container to provide three separate compartments with the centrally located panel lying adjacent to one side wall, the first and second pairs of panels are oriented to extend diagonally from two adjacent corners of the outer container toward the center thereof, the abbreviated flaps that are foldably attached to the second pair of panels are reversely folded into the compartment formed by the central panel and the first and second pair of panels to engage and retain a first bottle of hazardous material, the third pair of panels are reversely folded to extend away from the center of the outer container in a direction substantially perpendicular to two opposed side walls of the outer container, the fourth pair of panels are folded to lie adjacent to the two opposed side walls of the outer container, the fifth pair of panels are folded to lie adjacent to the remaining side wall of the container opposite the side wall where the central panel is located, the sixth pair of panels are folded to lie adjacent to one another and extend substantially perpendicular from the remaining side wall toward the center of the outer container.

7. The container of claim 6 wherein the third, fourth, fifth and sixth panels of each of the pairs together form two additional compartments within the outer container.

8. The container of claim 7 wherein the abbreviated flaps that are foldably attached to the third pair of panels cooperate with the abbreviated flaps foldably attached to the sixth pair of panels to provide engaging and retaining means for two additional bottles of hazardous materials located within the second and third compartments.

* * * * *